US012404645B2

(12) United States Patent
Johnson

(10) Patent No.: US 12,404,645 B2
(45) Date of Patent: Sep. 2, 2025

(54) CANINE FECES RAKE DEVICE

(71) Applicant: Lisa Johnson, Billings, MT (US)

(72) Inventor: Lisa Johnson, Billings, MT (US)

( * ) Notice: Subject to any disclaimer, the term of this patent is extended or adjusted under 35 U.S.C. 154(b) by 835 days.

(21) Appl. No.: 17/700,592

(22) Filed: Mar. 22, 2022

(65) Prior Publication Data

US 2023/0304239 A1 Sep. 28, 2023

(51) Int. Cl.
*E01H 1/12* (2006.01)

(52) U.S. Cl.
CPC ..... *E01H 1/1206* (2013.01)

(58) Field of Classification Search
CPC ..... E01H 1/1206
See application file for complete search history.

(56) References Cited

U.S. PATENT DOCUMENTS 3,735,574 A * 5/1973 Heckner ..... A01D 7/00 172/380
4,097,082 A 6/1978 Orofino
4,179,145 A 12/1979 Shinsako
4,741,566 A 5/1988 Byung-Do
6,230,367 B1 * 5/2001 Riedl ..... B25H 3/006 16/436
6,736,436 B1 * 5/2004 Tsou ..... E01H 1/1206 294/1.4
8,002,319 B1 8/2011 Hahn
8,635,750 B1 * 1/2014 Ginocchio ..... H02G 3/32 24/30.5 R
8,777,283 B2 7/2014 McNair
9,775,272 B1 * 10/2017 Gilbert ..... B25G 1/06
9,850,632 B1 * 12/2017 Hays ..... A01K 23/005
D860,550 S 9/2019 Filmer
2009/0058114 A1 * 3/2009 Diehl ..... E01H 1/1206 294/1.4
2011/0099765 A1 * 5/2011 Youssefieh ..... A01D 7/00 15/147.1
2012/0192540 A1 * 8/2012 Macyszyn ..... A01D 7/00 56/400.01
2012/0235431 A1 * 9/2012 Beaton ..... A01K 23/005 294/1.3
2012/0274089 A1 11/2012 Green
2016/0153158 A1 * 6/2016 Karius ..... E01H 1/1206 294/1.3
2017/0191235 A1 * 7/2017 Bean ..... A01K 23/005
2018/0058025 A1 * 3/2018 Filmer ..... E01H 1/1206
2018/0184568 A1 * 7/2018 Martin ..... A01B 1/16
(Continued)

FOREIGN PATENT DOCUMENTS

GB 2459912 A * 11/2009 ..... B25G 1/04
WO WO2016140586 9/2016

*Primary Examiner* — Thomas E Lazo

(57) ABSTRACT

A canine feces rake device for manually removing canine feces with a plurality of prongs includes a handle. A foam wrap is enwrapped around an exterior surface of the handle and provides an area fore the user to grasp the handle. A shaft protrudes out from an end of the foam wrap. An end of the shaft can be inserted in a port of a rake. The port has a pair of holes and each of the holes has threading. A pair of screws engages by threading with the pair of holes and helps retain the shaft in a fixed position relative to the rake. A plurality of prongs extends out from an edge of the rake and has a curvature. The plurality of prongs scoops the canine feces and transports the canine feces to a waste container.

15 Claims, 4 Drawing Sheets

(56) References Cited

U.S. PATENT DOCUMENTS

| | | | | |
|---|---|---|---|---|
| 2019/0224837 | A1* | 7/2019 | Hoell, III | B25G 1/102 |
| 2019/0246867 | A1* | 8/2019 | Ziamandanis | B25G 1/04 |
| 2019/0338480 | A1* | 11/2019 | Fulbrook | E01H 1/1206 |
| 2019/0390421 | A1* | 12/2019 | Seibold | A01D 7/06 |
| 2020/0128793 | A1* | 4/2020 | Fredrickson | A01B 1/026 |

* cited by examiner

CANINE FECES RAKE DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to animal feces removal devices and more particularly pertains to a new animal feces removal device for manually removing canine feces with a plurality of prongs.

(2) Description of Related Art Including Information Disclosed Under 37 CFR 1.97 and 1.98

The prior art relates to animal feces removal devices. Known prior art includes a variety of animal feces removal devices comprising a shaft with a scooping mechanism coupled to the end of said shaft. Known prior art lacks an animal feces removal device including a plurality of prongs for manual removal of canine feces with a loop at an end of the shaft for securing the device to a fastener.

BRIEF SUMMARY OF THE INVENTION

An embodiment of the disclosure meets the needs presented above by generally comprising a handle. The handle has an exterior surface. A foam wrap is enwrapped about the exterior surface of the handle. The handle is configured for providing an area for the user to grasp the handle. A shaft is protruding out from an end of the foam wrap. The shaft has an end. A rake has a port, and the port has an interior space. The interior space defines a space for the end of the shaft to be nested within. The port has a pair of holes. Each of the holes has threading. A pair of screws has threading and the pair of screws is configured for engaging by threading with the pair of holes. A plurality of prongs is positioned on an edge of the rake. The plurality of prongs protrudes out from the rake. The plurality of prongs is configured for scooping canine feces and transporting the canine feces to a waste container.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
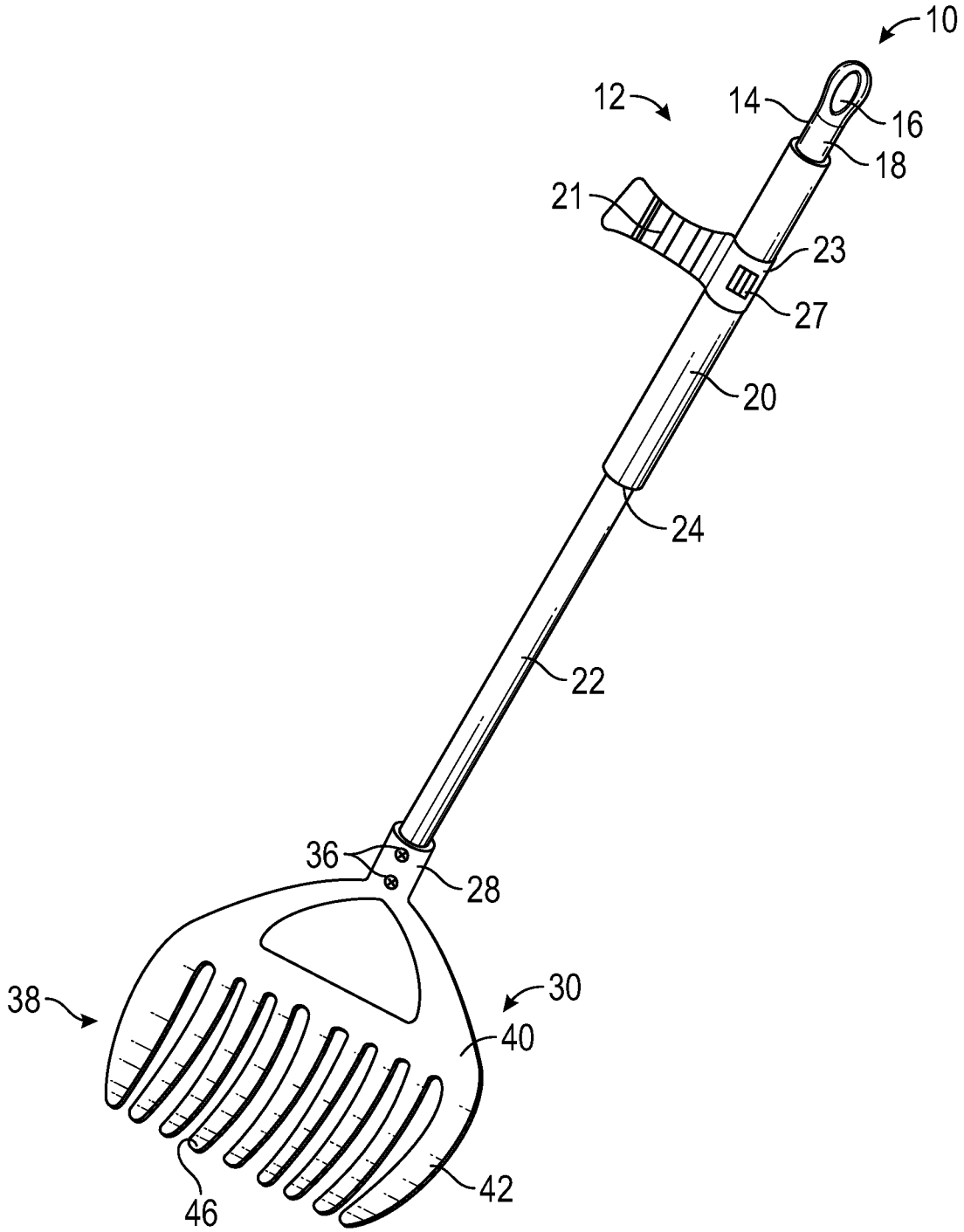
FIG. 1 is a perspective view of a canine feces rake device according to an embodiment of the disclosure.
Figure 2:
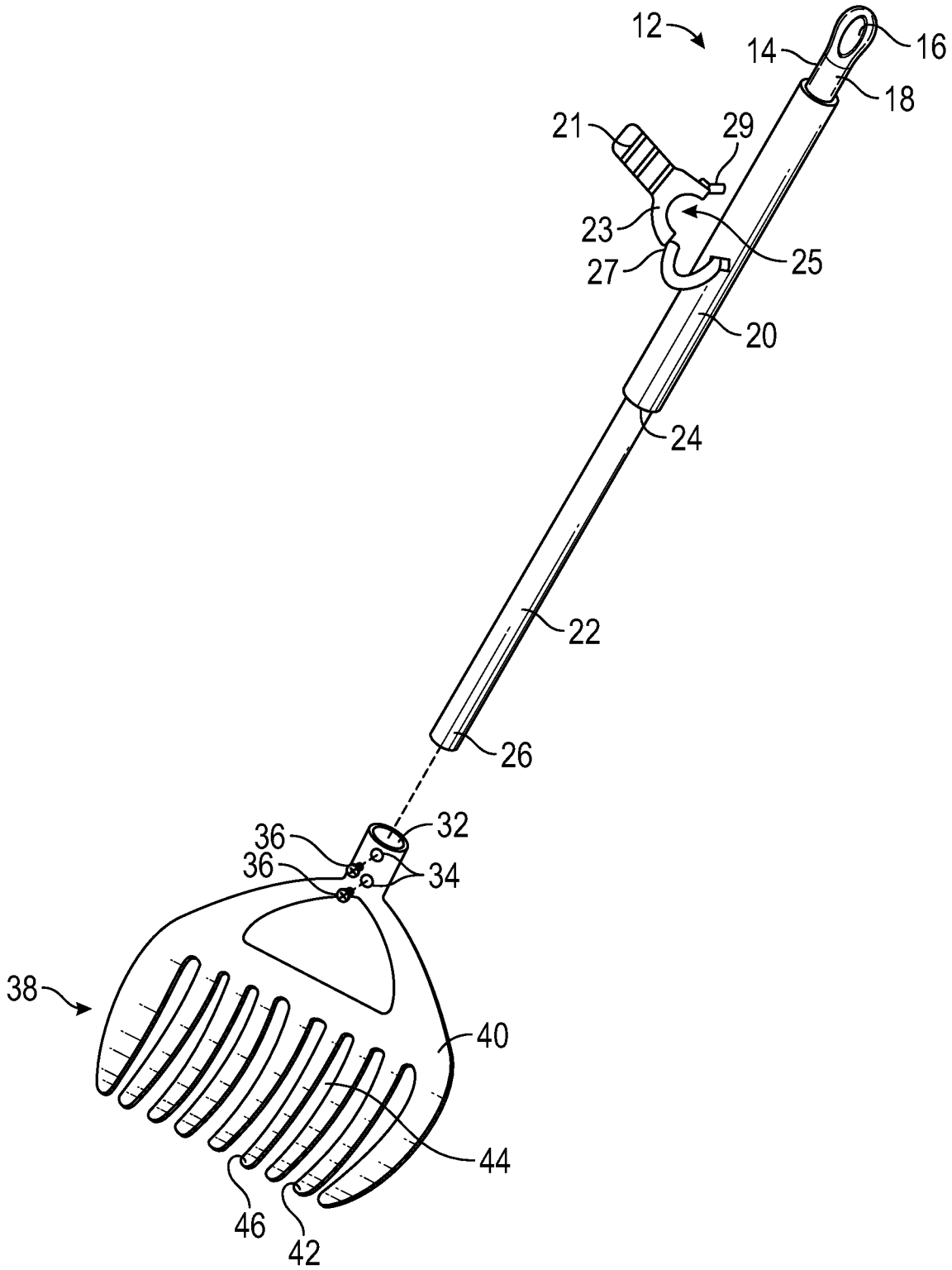
FIG. 2 is an exploded view of an embodiment of the disclosure.
Figure 3:
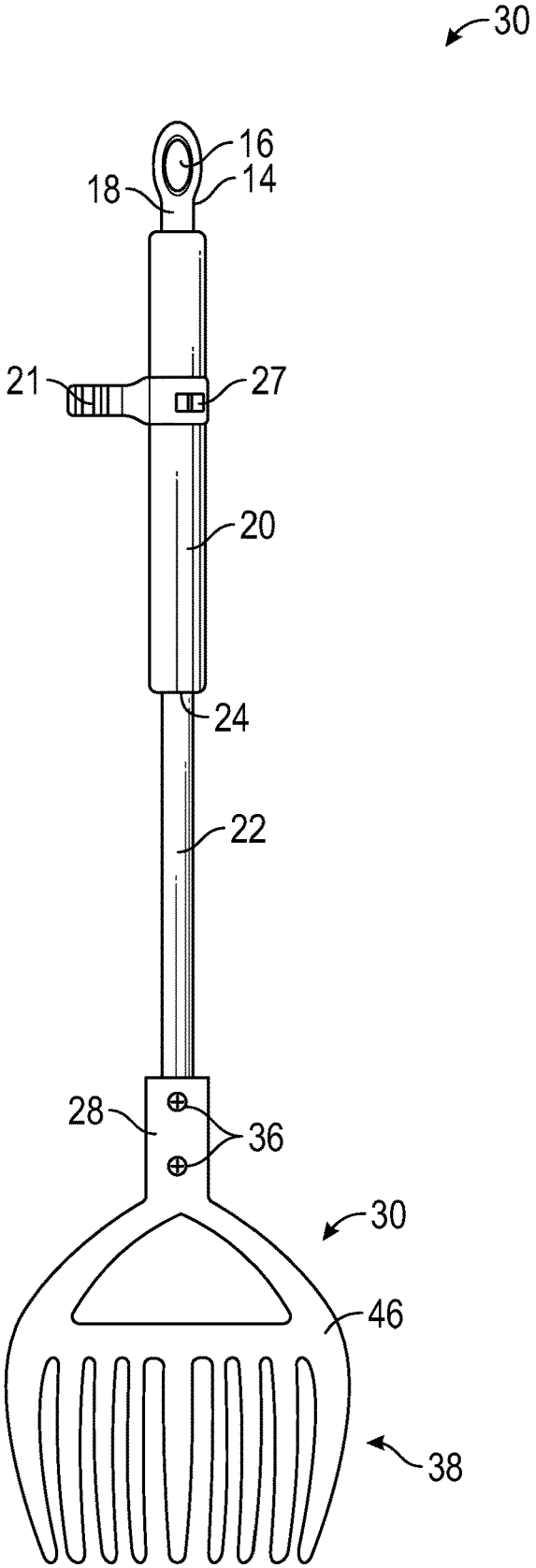
FIG. 3 is a side view of an embodiment of the disclosure.
Figure 4:
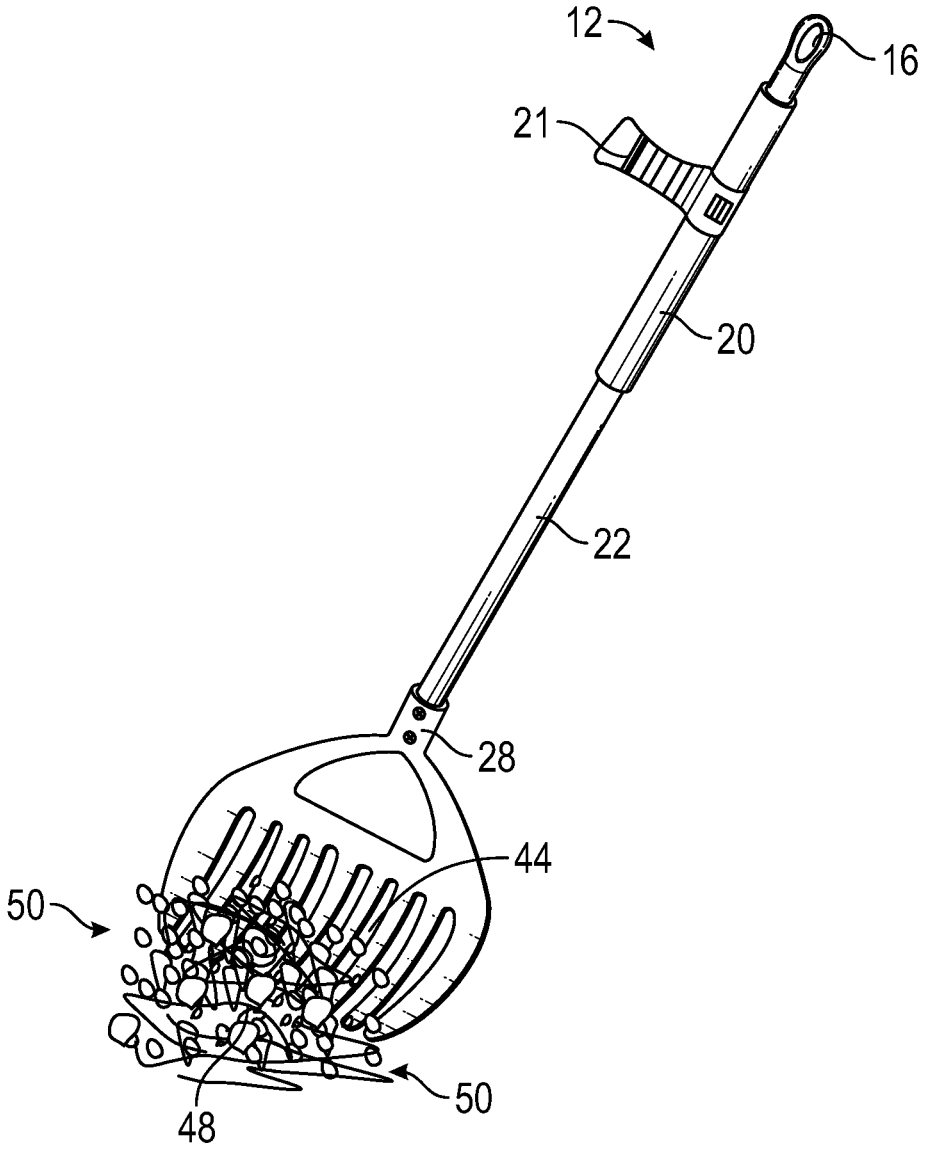
FIG. 4 is an in-use view of an embodiment of the disclosure.

With reference now to the drawings, and in particular to FIGS. 1 through 4 thereof, a new animal feces removal device embodying the principles and concepts of an embodiment of the disclosure and generally designated by the reference numeral 10 will be described.

As best illustrated in FIGS. 1 through 4, the canine feces rake device 10 generally comprises a handle 12. The handle 12 is a cylindrical rod. The handle 12 has an end 14, and the end 14 of the handle 12 has an aperture 16. The aperture 16 of the handle 12 is circular. The aperture 16 is configured for a variety of fasteners to attach to the handle 12. The aperture 16 allows the canine feces rake device 10 the ability to be suspended by a hook. Furthermore, the handle 12 has an exterior surface 18. A foam wrap is enwrapped about the exterior surface 18 of the handle 12. The foam wrap 20 ameliorates the grasp of the handle 12 while also providing comfort to the hands of the user.

A grip 21 is able to couple to the handle 12. The grip 21 is an attachable handle and is configured for being positioned perpendicular relative to the handle 12 when attached. The grip 21 has a clasp 23 that is cylindrical shaped. The clasp 23 has a cavity that defines a space for enwrapping around the exterior surface 18 of the handle 12. The clasp 23 can be positioned in an open or closed position. A hinge 27 is coupled to the clasp 23 and to the grip 21. The hinge 27 defines a junction to adjust the positioning between the clasp 23 and the grip 21 to an open and close position. The clasp 23 has a latch 29 that secures the clasp 23 in a closed position by fastening the clasp 23 to the grip 21.

A shaft 22 is positioned at an end 24 of the foam wrap 20. The shaft 22 is a cylindrical shaped tube that protrudes out from the end 24 of the foam wrap 20. The clasp 23 of the grip 21 can attach to the shaft 22 as well as the handle 12.

The shaft 22 has an end 26 which is a free end and provides an area for the shaft to be inserted into a port 28 of a rake 30. The port 28 of the rake 30 has a cylindrical shape with an interior space 32. The interior space 32 defines a space for the end 26 of the shaft 22 to be nested within. The port 28 has a pair of holes 34. Each of the holes 34 is circular and each of the holes 34 has threading. Each of the holes 34 is parallel to each other and the pair of holes 34 is coplanar to a longitudinal axis of the shaft 22.

Each screw 36 of a pair of screws 36 has threading and the pair of screws 36 is complementary to the pair of holes 34 of the rake 30. Each of the screws 36 is a set screw that is configured for being easily inserted into the pair of holes 34 and pressed against the end 26 of the shaft 22 to help retain the shaft 22 in a fixed position relative to the rake 30. The pair of screws 36 is configured for engaging by threading with the pair of holes 34 of the rake 30.

A plurality of prongs 38 is positioned on an edge 40 of the rake 30. Each of the prongs 38 protrudes outward from the edge 40 of the rake 30, and each of the prongs 38 has a curvature 42. The curvature 42 of each of the prongs 38 helps define a concave shape 44 of the rake 30. The concave shape 44 of the rake 30 provides an area for the canine feces 48 to be stored within when in-use. Each of the prongs 38 has an end 46, and the end 46 of each of the prongs 38 is pointed. The end 46 of each of the prongs 38 facilitates the process of scooping up canine feces 48 and other animal feces from the terrain surface 50 where the canine feces 48 are located.

In use, the user grasps the foam wrap 20 of the handle 12. The user positions the end 46 of each of the prongs 38 at the base of the canine feces 48. Therefrom, the user can push the plurality of prongs 38 of the rake 30 forward to gather a majority of the canine feces 48. The user repeats this process until the canine feces 48 are gathered within the rake 30. The user can then transport the canine feces 48 to a waste container for disposal. The rake 30 can be removed from the shaft 22 by removing the pair of screws 36 from the pair of holes 34 of the rake 30. Once removed, the rake 30 can be cleaned for further use. The shaft 22 can be secured to a hook or other fasteners by using the aperture 16 at the end 14 of the handle 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A canine feces rake device comprising:

a handle, said handle having an exterior surface, a foam wrap being enwrapped about said exterior surface of said handle, said handle being configured for providing an area for the user to grasp said handle;

a grip, said grip being an attachable handle, said grip having a clasp, said clasp being a cylindrical shape, said clasp having a cavity, said cavity defining a space to be enwrapped around said exterior surface of said handle, said clasp being configured for being positioned in an opening and closing position, a hinge being coupled to said clasp and to said grip, said clasp having a latch, said latch being configured for securing said clasp in a closed position, said grip being configured for attaching perpendicular relative to said handle;

a shaft, said shaft protruding out from an end of said foam wrap, said shaft having an end;

a rake, said rake having a port, said port having an interior space, said interior space defining a space for said end of said shaft to be nested within, said port having a pair of holes, each of said holes having threading;

a pair of screws, said pair of screws having threading, said pair of screws being configured for engaging by threading with said pair of holes; and a plurality of prongs, said plurality of prongs being positioned on an edge of said rake, said plurality of prongs protruding out from said rake, said plurality of prongs being configured for scooping canine feces and transporting the canine feces to a waste container.

2. The canine feces rake device of claim 1, further comprising said handle being a cylindrical rod.

3. The canine feces rake device of claim 1, further comprising said handle having an end, said end having an aperture, said aperture being circular.

4. The canine feces rake device of claim 3, further comprising said aperture being configured for a variety of fasteners attaching to said handle.

5. The canine feces rake device of claim 1, further comprising said shaft being a tube.

6. The canine feces rake device of claim 1, further comprising said shaft being a cylindrical shape.

7. The canine feces rake device of claim 1, further comprising said end of said shaft being a free end.

8. The canine feces rake device of claim 1, further comprising said port being a cylindrical shape.

9. The canine feces rake device of claim 8, further comprising each of said prongs having an end.

10. The canine feces rake device of claim 1, further comprising each of said holes of said rake being circular.

11. The canine feces rake device of claim 10, further comprising said end of each of said prongs being pointed.

12. The canine feces rake device of claim 1, further comprising each of said screws being a set screw.

13. The canine feces rake device of claim 1, further comprising said pair of screws being complementary to said pair of holes.

14. The canine feces rake device of claim 1, further comprising each of said prongs having a curvature.

15. A canine feces rake device comprising:

a handle, said handle being a cylindrical rod, said handle having an end, said end having an aperture, said aperture being circular, said aperture being configured for a variety of fasteners attaching to said handle, said handle having an exterior surface, a foam wrap being enwrapped about said exterior surface of said handle, said handle being configured for providing an area for the user to grasp said handle;

a grip, said grip being an attachable handle, said grip having a clasp, said clasp being a cylindrical shape, said clasp having a cavity, said cavity defining a space to be enwrapped around said exterior surface of said handle, said clasp being configured for being positioned in an opening and closing position, a hinge being coupled to said clasp and to said grip, said clasp having a latch, said latch being configured for securing said clasp in a closed position, said grip being configured for attaching perpendicular relative to said handle;

a shaft, said shaft being a tube, said shaft protruding out from an end of said foam wrap, said shaft being a cylindrical shape, said shaft having an end, said end being a free end;

a rake, said rake having a port, said port being a cylindrical shape, said port having an interior space, said interior space defining a space for said end of said shaft to be nested within, said port having a pair of holes, each of said holes being circular, each of said holes having threading;

a pair of screws, each of said screws being a set screw, said pair of screws having threading, said pair of screws being configured for engaging by threading with said pair of holes, said pair of screws being complementary to said pair of holes; and a plurality of prongs, said plurality of prongs being positioned on an edge of said rake, said plurality of prongs protruding out from said rake, each of said prongs having a curvature, each of said prongs having an end, said end of each of said prongs being pointed, said plurality of prongs being configured for scooping canine feces and transporting the canine feces to a waste container.

* * * * *